United States Patent [19]

Leone et al.

[11] Patent Number: 4,635,011

[45] Date of Patent: Jan. 6, 1987

[54] CIRCUIT BREAKER WITH ARM LATCH FOR HIGH INTERRUPTING CAPACITY

[75] Inventors: David A. Leone, Aliquippa; Douglas C. Marks, N. Braddock, both of Pa.

[73] Assignee: Westinghouse Electric Corp., Pittsburgh, Pa.

[21] Appl. No.: 729,436

[22] Filed: May 1, 1985

[51] Int. Cl.[4] ..... H01H 75/00

[52] U.S. Cl. ..... 335/16

[58] Field of Search ..... 335/16, 147, 195

[56] References Cited

U.S. PATENT DOCUMENTS 4,503,408 3/1985 Mrenna et al. ..... 335/35

4,540,961 9/1985 Maier ..... 335/16

*Primary Examiner*—Michael L. Gellner

*Assistant Examiner*—Brian W. Brown

*Attorney, Agent, or Firm*—L. P. Johns

[57] ABSTRACT

An electric circuit breaker with high interrupting capacity characterized by a multi-phase circuit breaker including a crossbar rotatable on its longitudinal axis and having an enlarged portion; a contact carrying arm pivotally mounted on the enlarged portion in response to an overload current at a positions paced from the axis; and a spring biased retainer contacting the arm for yieldingly retaining the arm in a contact closed position below a predetermined current rating.

6 Claims, 6 Drawing Figures

CIRCUIT BREAKER WITH ARM LATCH FOR HIGH INTERRUPTING CAPACITY

CROSS REFERENCE TO RELATED APPLICATIONS

This application is related to the copending applications Ser. No. 562,647, filed Dec. 19, 1983, entitled "Molded Case Circuit Breaker with an Apertured Molded Crossbar for Supporting a Movable Electrical Contact Arm" of A. E. Maier, now U.S. Pat. No. 4,540,961; Ser. No. 562,647, filed Dec. 19, 1983, entitled "Molded Case Circuit Breaker with Combined Position Indicator and Handle Barrier" of J. R. Farley and R. H. Flick; and Ser. No. 755,397, filed July 12, 1985, entitled "Current Limiting Circuit Breaker with Arc Commuting Structure", of W. E. Beatly, J. L. McKee, S. R. Thomas, and Y. K. Chien, all assigned to the present assignee.

BACKGROUND OF THE INVENTION

1. Field of the Invention

The invention relates to circuit breakers and, more particularly, it pertains to a spring biased retainer for holding a contact arm in the contact closed position.

2. Description of the Prior Art

Electric circuit breakers are employed to provide circuit protection for low voltage distribution systems. They provide protection for an electrical circuit or system against electrical overcurrent conditions, such as overload conditions as well as low and high level short circuit or fault current conditions.

An essential ingredient to the successful interruption of overcurrent conditions in relatively small circuit breakers is the ability of the circuit breaker's contact arm to "unlatch" and open as quickly as possible upon inception of a condition. A resisting force to contact arm unlatching is termed the "blow open" force. A disadvantage of relatively small circuit breakers has been the lack of means for maintaining a very low "blow open" force while also providing a consistent contact pressure necessary for reliable continuous current carrying operation.

SUMMARY OF THE INVENTION

In accordance with this invention, an electric circuit breaker is provided which comprises an electrically insulating housing having a base and cover; a circuit breaker unit within the housing and having a pair of separable contacts operable between open and closed positions; the circuit breaker unit including a releasable member; a trip mechanism movable in response to a first force caused by the occurrence of a predetermined electric current overload to release the releasable mechanism; the circuit breaker unit including a contact arm carrying one of the contacts, a repulsion magnetic force sustained between the contacts which force is proportional to the current load flowing through the contacts; mounting means mounting the contact arm for movement about a first pivot upon actuation of the trip mechanism; the mounting means also including a second pivot for the contact arm and including spring biasing means for maintaining the contact arm in contact closed position; the spring biasing means having a second force less than the first force and greater than the repulsion magnetic force to cause the arm to anticipate opening of the contacts in response to a current greater than the predetermined current overload; the spring biasing means including a coil spring and a spring follower; the spring follower having a latching surface and a ramp; the contact arm including a tail portion on the side of the second pivot opposite the contact which portion comprises a camming surface and a base surface; the latching surface engaging the base surface when the contacts are closed; and the camming surface engaging the ramp when the contacts are open.

Where the circuit breaker of the foregoing description is a multi-phase structure, it includes a crossbar extending between the several phases thereof, with the first pivot extending longitudinally through the crossbar, and with the crossbar comprising an enlarged portion with an enclosed opening therein in which the second pivot is disposed at a location between the first pivot and said one contact.

The advantage of the circuit breaker of this invention is that it comprises a mechanical cam latch which provides a low ratio of "blow open" force to contact force for the contact arm of the circuit breaker thereby enabling the contact arm to open as quickly as possible during overcurrent fault conditions while providing consistent contact pressure necessary for continuous current carrying operation.

DESCRIPTION OF THE PREFERRED EMBODIMENT

Figure 1:
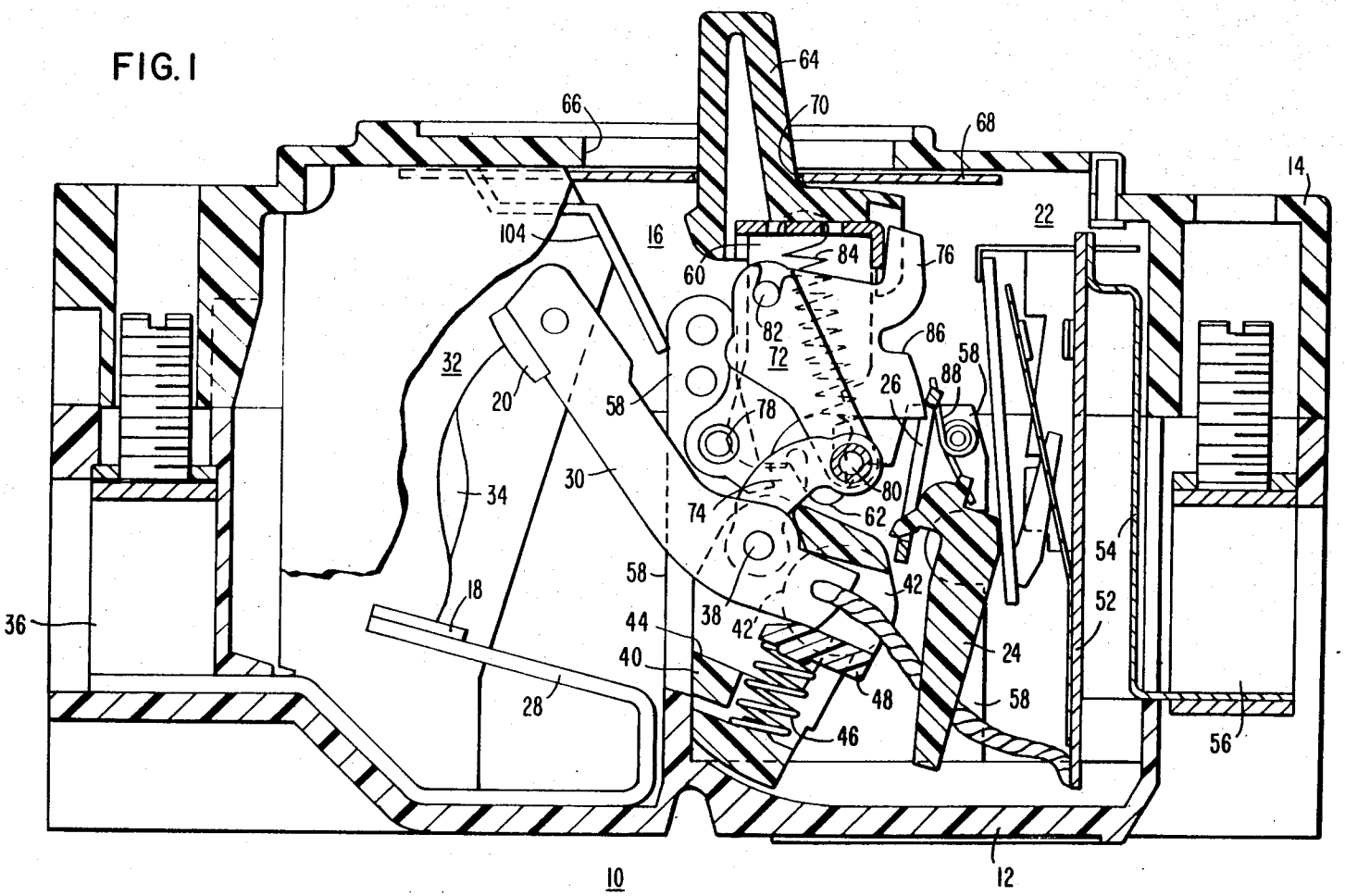
FIG. 1 is a vertical sectional view through a multiple pole circuit breaker shown in the tripped position.

In FIG. 1 a circuit breaker is generally indicated at 10 and it comprises an insulating housing 12 which includes a cover 14, a circuit breaker mechanism 16, and a pair of separable contacts including a fixed contact 18 and a movable contact 20. The circuit breaker may be of a single or multiple pole construction, the latter of which comprises insulating barriers separating the interior of the housing into adjacent side-by-side pole unit compartments in a well-known manner.

For a multiple pole unit, such as a three-pole circuit breaker, the mechanism 16 is a single latch device disposed in the center pole unit. However, each pole unit includes a separate thermal trip device 22 for rotating a tie bar 24 which in turn actuates a latch lever 26.

The separable contacts 18, 20 are mounted on a conductor 28 and a contact carrying arm 30, respectively, and are provided in each pole unit of the breaker. An arc extinguishing unit 32 is also provided for each pole unit for extinguishing any arc 34 which occurs during separation on the contacts 18, 20. The conductor 28 extends from line terminal 36. The contact arm 30 is pivotally mounted at pivot 38 on an enlarged portion 40 of a crossbar 42. For that purpose, the end portion of the contact arm is seated within an opening 44 of the enlarged portion 40 where it is subject to spring biasing means including a coil spring 46 and a spring follower 48. When the contacts 18, 20 are closed (FIG. 2), a circuit through the circuit breaker extends from the terminals 36 through the conductor 28, contacts 18, 20, contact arm 30, a flexible conductor or shunt 50, a bimetal strip 52, and a conductor 54 to a load terminal 56.

The operating mechanism 16 is described more fully in U.S. Pat. No. 4,503,408, for which reason the mechanism is not described herein in detail. The mechanism 16 is positioned in the center pole unit of the three pole circuit breaker and is supported between a pair of rigid space plates, one of which plates 58 is shown that is fixedly secured to the base of the housing 12 in the center pole unit of the breaker. An inverted U-shaped operating lever 60 is pivotally supported on the spaced plates 58 with the ends of the legs of the lever 43 positioned in U-shaped notches 62 of the plates. The U-shaped operating lever 60 includes a handle 64 which extends through a slot 66 in the cover 14 of the housing. A slide plate or dust cover 68 having a hole 70 is mounted on the handle and slides with the handle to cover the unoccupied portions of the slot 66.

The contact arm 30 is operatively connected by a toggle mechanism which comprises an upper toggle link 72 and a lower toggle line 74 to a releasable member or cradle 76 that is pivotally supported at 78 to the support plates 58. The toggle links 72, 74 are pivotally connected by a knee pivot pin 80. The upper toggle line 72 is pivotally connected at 82 to the cradle 76 and the lower toggle link 74 is pivotally connected by the pivot 38 to the enlarged portion 40 of the crossbar 42. Overcenter operating springs 84 are connected under tension between the knee pivot pin 80 and the bight portion of the lever 60.

The contacts 18 and 20 are manually opened by movement of the handle 64 in a rightward direction from the on position (FIG. 2) to an off position (FIG. 1). As a result, rotating movement of the operating lever 60 carries the line of action of the overcenter operating springs 84 to the right, causing collapse of the toggle links 72, 74 to thereby rotate the crossbar 42 and simultaneously raise the contact arm 30 of each pole unit to the open position, opening the contacts of the three pole units.

The contacts are manually closed by reverse movement of the handle 64 to the left from the off to the on position, which movement moves the line of action of the overcenter springs 84 to the left (FIG. 2) to move the toggle linkage 72, 74. This movement rotates the crossbar 42 counterclockwise to move the upper contact arms 30 of the three pole units to the closed position.

Figure 2:
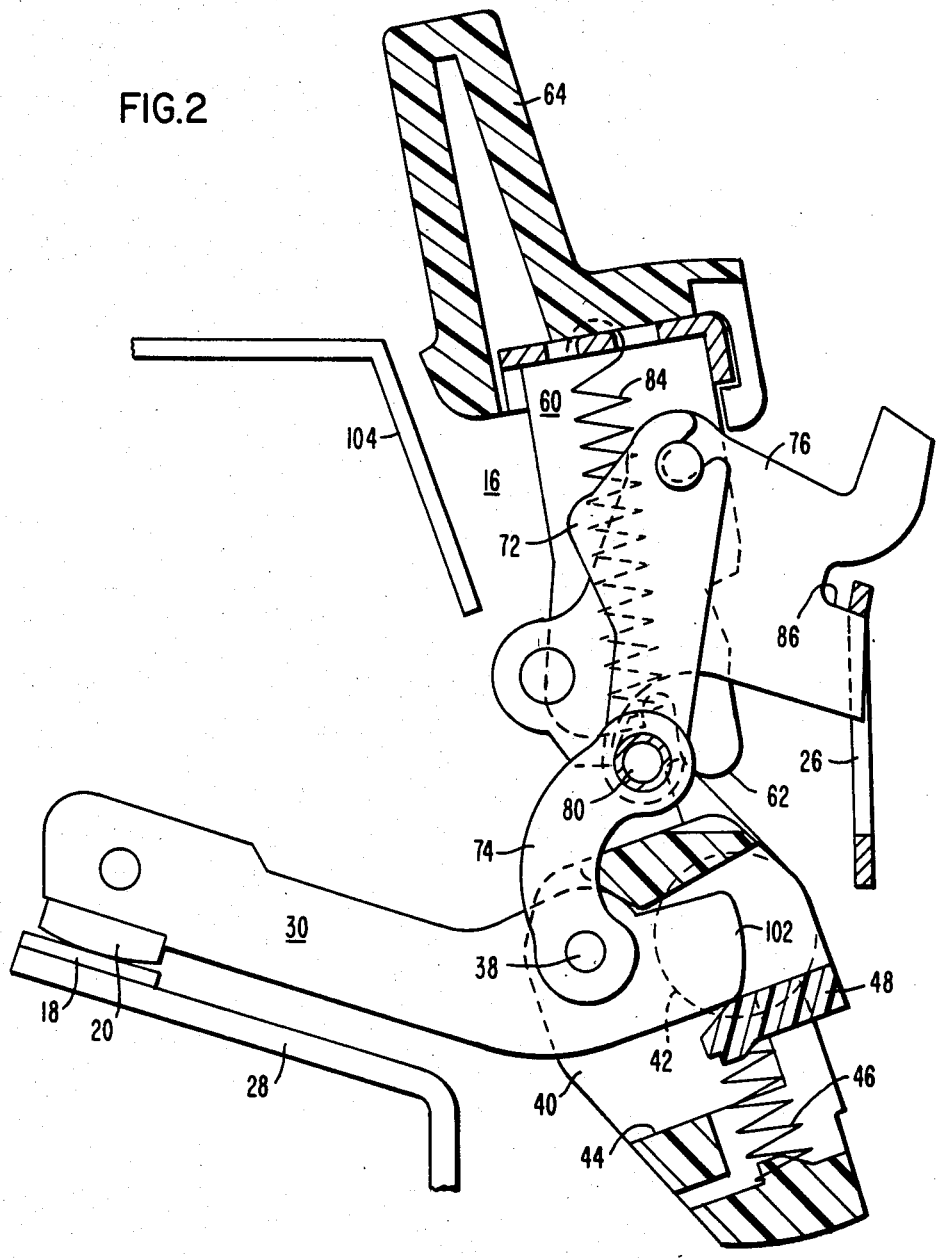
FIG. 2 is an enlarged fragmentary view of the circuit breaker in the closed contact position.
Figure 3:
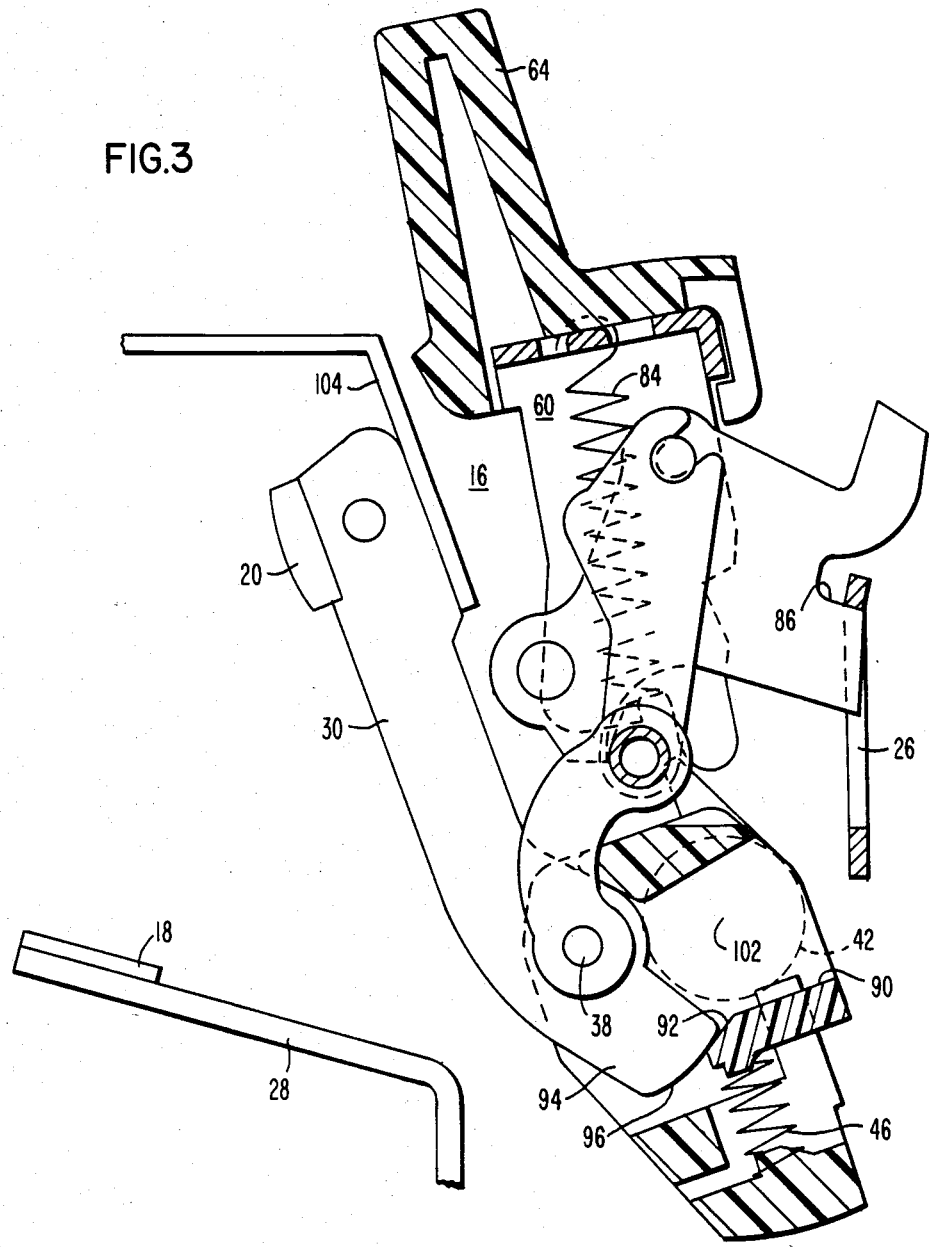
FIG. 3 is a view similar to FIG. 2 with the contacts in the "blown open" position.
Figure 4:
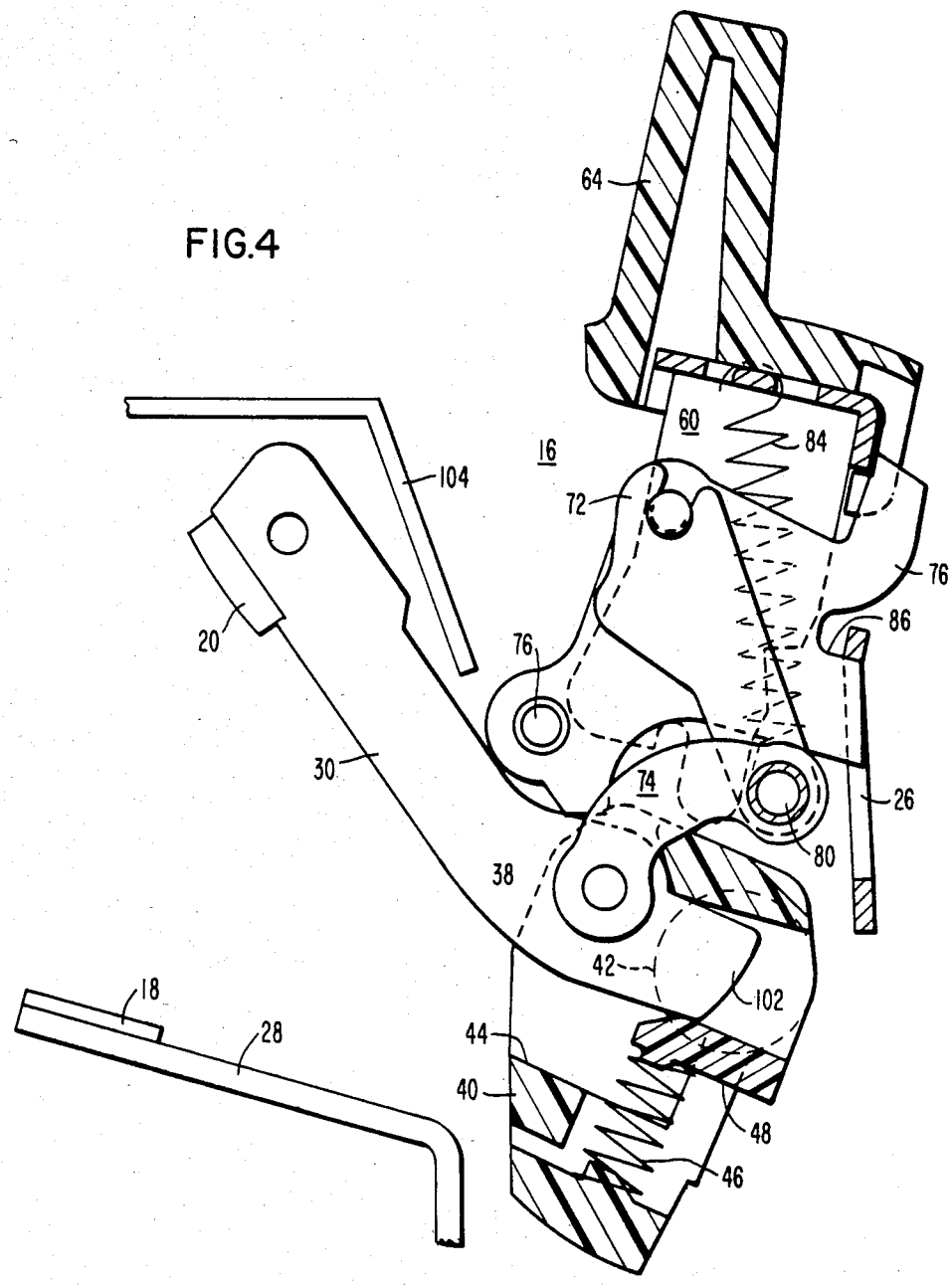
FIG. 4 is a view similar to FIG. 3 with the contact in the reset or open position.

In FIG. 1 the releasable cradle 76 is shown in the unlatched position which occurs when the circuit breaker is tripped. The cradle 76 is shown in the latched position in FIGS. 2, 3 and 4, whereby the upper end of the latch lever 26 is lodged within a notch 86 of the cradle. The latch lever 26, being part of the thermal trip device 22, is actuated between the latched and unlatched positions as shown in FIGS. 2 and 1 respectively. Thus the latch lever 26 is actuated by the tie-bar 24 upon movement of it by the bimetal strip 52. A bias spring 88 mounted on one of the support plates 58 urges the latch lever 26 into the notch 86 when the handle 64 is rotated clockwise to a reset position for moving the lever 60 against the upper end of the cradle 76 whereby the notch 86 is lowered into the latched position with the lever 26 (FIG. 4).

Figure 5:
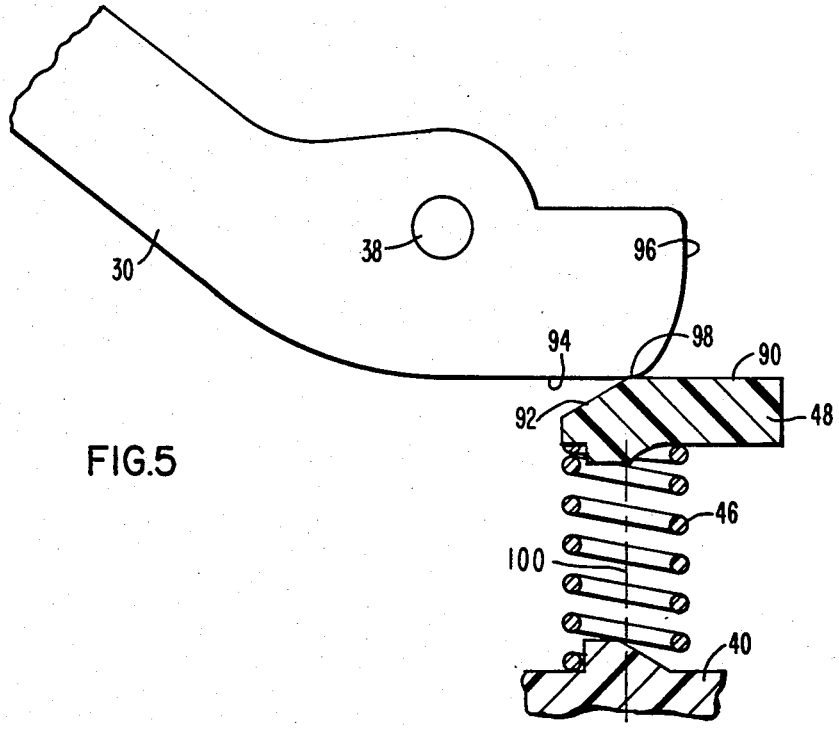
FIG. 5 is an enlarged fragmentary view showing the relationship between the contact arm and the spring biasing mechanism.

In accordance with this invention the contact arm 30 is mounted in the opening 44 of the enlarged portion 40 where it is retained for pivotal rotation about the pivot pin 38. Spring biasing means including the spring 46 and spring follower 48 also act upon the arm 30 for retaining the lever normally in the position shown in FIGS. 1, 2 and 4 in which position the contact arm is normally movable between open and closed positions. As shown more particularly in FIG. 5 the contact arm 30 is biased by the spring 46 acting through the spring follower 48. The spring follower includes a flat latching surface 90 and a ramp 92. The arm 30 includes a flat latching surface 94 and a cam 96. As shown in FIG. 5 the latching surfaces 90, 94 are in surface-to-surface abutment in a plane at a location 98 which plane is substantially perpendicular to an axis 100 of the spring 46. Thus, the pressure of the coil spring 46 is directed squarely against the abutting latching surfaces at 98. Accordingly, under normal current conditions the arm 30 is rotated between open and closed positions of the contacts about a center axis 102 as it is rotated by the circuit breaker mechanism 16. When the crossbar 42 is rotated between the positions shown in FIGS. 1 and 2 the enlarged portion 40 including the assembly of the spring 46 and spring follower 48 rotate with the crossbar and arm 30.

When the contacts are closed (FIG. 2) current passes through the closely spaced conductor 28 and arm 30 in opposite directions, thereby forming repulsion magnetic forces due to oppositely disposed electromagnetic forces in each conductor. Under normal conditions the pressure of the spring 46 is applied on the arm 30 at location 98 is sufficient to maintain the closed contact condition.

However, where an overcurrent of high order, such as a short circuit, occurs, the repulsion forces between the conductor 28 and arm 30 exceeds the force of the spring 46 and the contact arm 30 rotates counterclockwise about the pivot pin 38. In other words, the repulsion force is sufficiently great to rotate the arm against the spring follower 48 with the cam 96 riding onto the ramp 92 (FIG. 3).

In a time substantially equal to the fraction of the current cycle, the bimetal strip 52 actuates the latch lever 26 to trip the circuit breaker mechanism 16, causing the enlarged portion 40 of the crossbar 42 to rotate clockwise. As a result the arm 30, being in contact with the barrier 104, is rotated back to the former position (FIG. 1) where it remains until the circuit breaker mechanism 16 is reset (FIG. 4).

By virtue of the foregoing construction, the current limiting circuit breaker blows open the contacts in an early stage of an overcurrent cycle, and sooner than the thermal trip device 22 is mechanically able to do so. In other words, the contact arm 30 "blows open" by a force exceeding that of the spring 46. The advantage of the structure of this invention is that the latching surfaces of the contact arm and the spring follower are directly in line thereby providing a simple and reliable spring-controlled mechanism.

Figure 6:
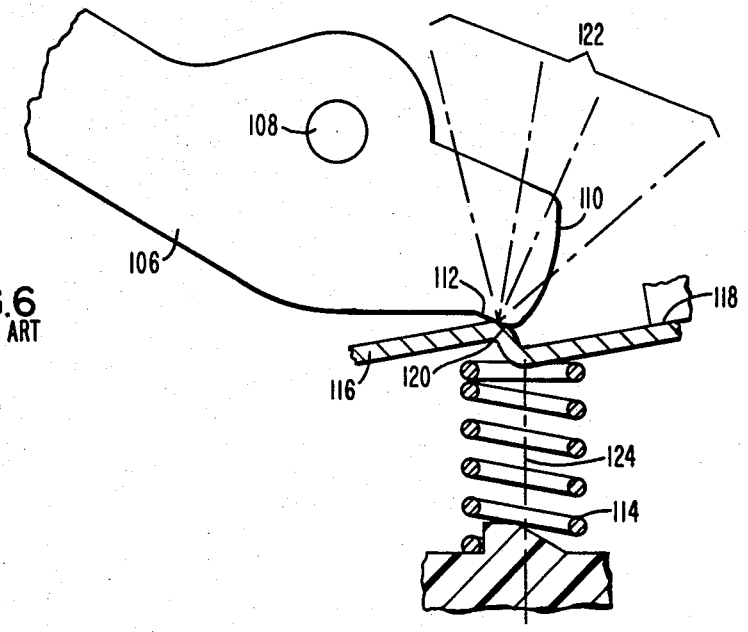
FIG.6 PRIOR ART
FIG. 6 is an enlarged fragmentary view showing a prior art structure.

In the prior art structure of FIG. 6 a contact arm 106 which is pivoted at pin 108 comprises a cam surface 110 and a latching surface 112. A coil spring 114 applies pressure on the latching surface through a spring follower 116 which is pivoted at 118. The follower 116 is a modified Z-shaped member having an arcuate surface 120 acting upon the latching surface 112. As a result of the prior art structure, the round or arcuate surface 120 acting as a lever pivoted at 118 provides a line contact with the latched surface 112 so that vector forces penetrate the lever 106 at varying angles such as angles 122 which cause variations in the contact force applied to the contacts 18, 20. Moreover, because of the line contact between the surfaces 112, 120, as compared with a definite area contact as provided by the latching surface 90, 94 (FIG. 5), the part of the softer metal, such as the copper contact arm 106, wears away due to repeated friction with the harder steel follower 116, whereby varying pressures of the spring force between the contact arm and follower are created over a period of time. Moreover, the force of the spring 114 is applied through a center axis 124 which is not aligned with the line of contact between the latching surface 112 and the arcuate surface 120 which causes the follower 116 to function as a third class lever which is a further disadvantage of the prior art structure. This prior art structure is shown in U.S. Pat. No. 4,540,961.

In conclusion, the device of this invention provides the essential ingredient for successful interruption of high fault currents in relatively small circuit breakers by providing the ability of a contact arm to unlatch and open as quickly as possible upon conception of a high fault current.

What is claimed is:

1. An electric circuit breaker with contact arm latch, comprising:

a circuit breaker unit having a pair of separable contacts operable between open and closed positions;

the circuit breaker unit including a releasable member;

a trip mechanism movable in response to a first force caused by the occurrence of a predetermined electric current overload to release the releasable member;

the circuit breaker unit including a contact arm carrying one of the contacts;

a repulsion magnetic force sustained between the contacts which force is proportional to the current load flowing through the contacts;

mounting means mounting the contact arm for movement above a first pivot upon actuation of the trip mechanism;

the mounting means also including a second pivot for the contact arm and including spring biasing means for maintaining the contact arm in the contact closed position;

the spring biasing means having a second force less than the first force and greater than the repulsion magnetic force to cause the arm to anticipate opening of the contacts in response to the current greater than the predetermined current overload, and the spring biasing means including a coil spring and a spring follower, the spring follower having a first flat latching surface and a ramp surface which surfaces intersect at an intersection, the contact arm including a tail portion on the side of the second pivot opposite the contact which portion comprises a camming surface and a second flat latching surface, the latching surfaces being in surface-to-surface abutment adjacent to the intersection and the axis of the coil spring being perpendicular to the plane of said abutment when the contacts are closed, and the camming surface engaging the ramp surface when the contacts are open.

2. The electric circuit breaker of claim 1 being a multi-phase structure and includes a crossbar extending between several phases.

3. The electric circuit breaker of claim 2 in which the first pivot extends longitudinally through the crossbar.

4. The electric circuit breaker of claim 3 in which the crossbar comprises an enlarged portion, and the second pivot being disposed on the enlarged portion at a location spaced from the crossbar axis.

5. The electric circuit breaker of claim 4 in which the second pivot is disposed between the first pivot and said one contact.

6. The electric circuit breaker of claim 5 in which the enlarged portion includes an enclosed opening in which the coil spring and spring follower are disposed.

* * * * *